US006827075B1

(12) United States Patent
Bellospirito

(10) Patent No.: US 6,827,075 B1
(45) Date of Patent: Dec. 7, 2004

(54) APPARATUS FOR BURNING STONE

(76) Inventor: Robert Bellospirito, 502 Atwell Hill Rd., Windsor, NY (US) 13865

( * ) Notice: Subject to any disclaimer, the term of this patent is extended or adjusted under 35 U.S.C. 154(b) by 0 days.

(21) Appl. No.: 10/299,615

(22) Filed: Nov. 20, 2002

(51) Int. Cl.[7] ..... B28D 1/32
(52) U.S. Cl. ..... 125/25; 125/1; 125/23.02; 125/27; 125/30.01; 125/35
(58) Field of Search ..... 125/1, 23.02, 25, 125/27, 30.01, 35

(56) References Cited

U.S. PATENT DOCUMENTS 2,655,909 A * 10/1953 Aitchison et al. ..... 125/1
3,717,332 A * 2/1973 Luker et al. ..... 266/23
5,091,625 A * 2/1992 Kohda et al. ..... 219/121.44
6,218,639 B1 * 4/2001 Bulle ..... 219/121.39
6,320,153 B1 * 11/2001 Hulings et al. ..... 219/121.39

* cited by examiner

*Primary Examiner*—Joseph J. Hail, III
*Assistant Examiner*—Shantese McDonald

(57) ABSTRACT

An automated stone burning apparatus, which precisely adjusts the burning operation and improves the throughput. The apparatus consists of a torch assembly that is mounted in proximity to a stone slab lying upon a roller bed. The torch assembly is movable both transversely and laterally (i.e., in orthogonal directions with respect to the stone slab). An electrical control system adjusts the speed and location of the torch during the burn process.

7 Claims, 4 Drawing Sheets

APPARATUS FOR BURNING STONE

FIELD OF THE INVENTION

The present invention relates to apparatuses for treating and working stone and, more particularly, to an improved stone burning apparatus that travels along the face of a stone slab at an adjustable rate, while the stone slab is supported upon a bed.

BACKGROUND OF THE INVENTION

The working of stone is as old as antiquity itself. Stonemasons have been practicing their craft since the time of the pharaohs in ancient Egypt. Stone burning is a known part of this art, and one that treats a stone slab or monolith after it has been quarried and shaped. Stones are generally burned to transform the characteristics of their outer surfaces, increasing their non-skid properties and producing a uniform texture. Flame finishing a stone will usually improve its texture, and impart a greater frictional coefficient to its surface.

In the past, the burning of stone surfaces was largely accomplished by hand, by passing a torch over the stone surface. In recent times, attempts have been made to provide torching tools that are adjustable and pressurized. These tools control the flame concentration. Also, stenciling devices have been developed to treat specific sections of the surface of the stone.

One stone burning product is produced by Park Industries, Inc. of St. Cloud, Minn. That system moves the stone work piece relative to a stationary torch, by means of an indexing conveyor. Depending upon the size of the stone, of course, the energy required to maneuver the work piece can be significant.

The present invention seeks to automate the burning of a stone slab, or monolith, in order to improve the throughput of the burning operation.

The current invention provides an apparatus for burning a bedded stone slab with a torch that is precisely moved, and positioned with respect to the stone surface. The precision of the burn provides a uniformly textured surface. Adjusting the speed of the burn allows for the use of different gas mixtures and optimizes the time required to accomplish the task.

SUMMARY OF THE INVENTION

In accordance with the present invention, there is provided an automated stone burning apparatus. The apparatus comprises a bed of conveying rollers for supporting and moving a stone slab or monolith adjacent a stone burning torch. The torch is supported upon a movable carriage that traverses the length of the stone surface to be burned. The torch is also part of a burn control assembly, which moves transversely of the carriage direction. The assembly consists of a telescoping wand, which is mounted on the carriage, and which is internally driven by a rotating worm. The assembly allows the torch to be placed at a precise distance from the surface of the stone, thus ensuring an accurate and controlled burn.

An electrical motor drives the rotating worm of the assembly. The motor speed is adjustable by an electrical signal from a control unit. A gear transmission box controls the speed of a pinion gear mounted upon the assembly. The pinion gear engages a stationary rack mounted to the stone bed and drives the assembly along the length of the stone.

The electrical motor also drives the gear transmission box. Adjusting the speed of the burning process allows for the use of different gas mixtures, and optimizes the throughput required to accomplish the task.

It is an object of this invention to provide an automated stone burning apparatus that provides a precise burn and improves the throughput of the stone burning process.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, the invention features an automated stone burning apparatus, which precisely adjusts the burning operation and improves the throughput. The apparatus consists of a torch assembly that is mounted in proximity to a stone slab lying upon a roller bed. The torch assembly is movable both transversely and laterally (i.e., in orthogonal directions with respect to the stone slab). An electrical control system adjusts the speed and location of the torch during the burn process.

Figure 1:
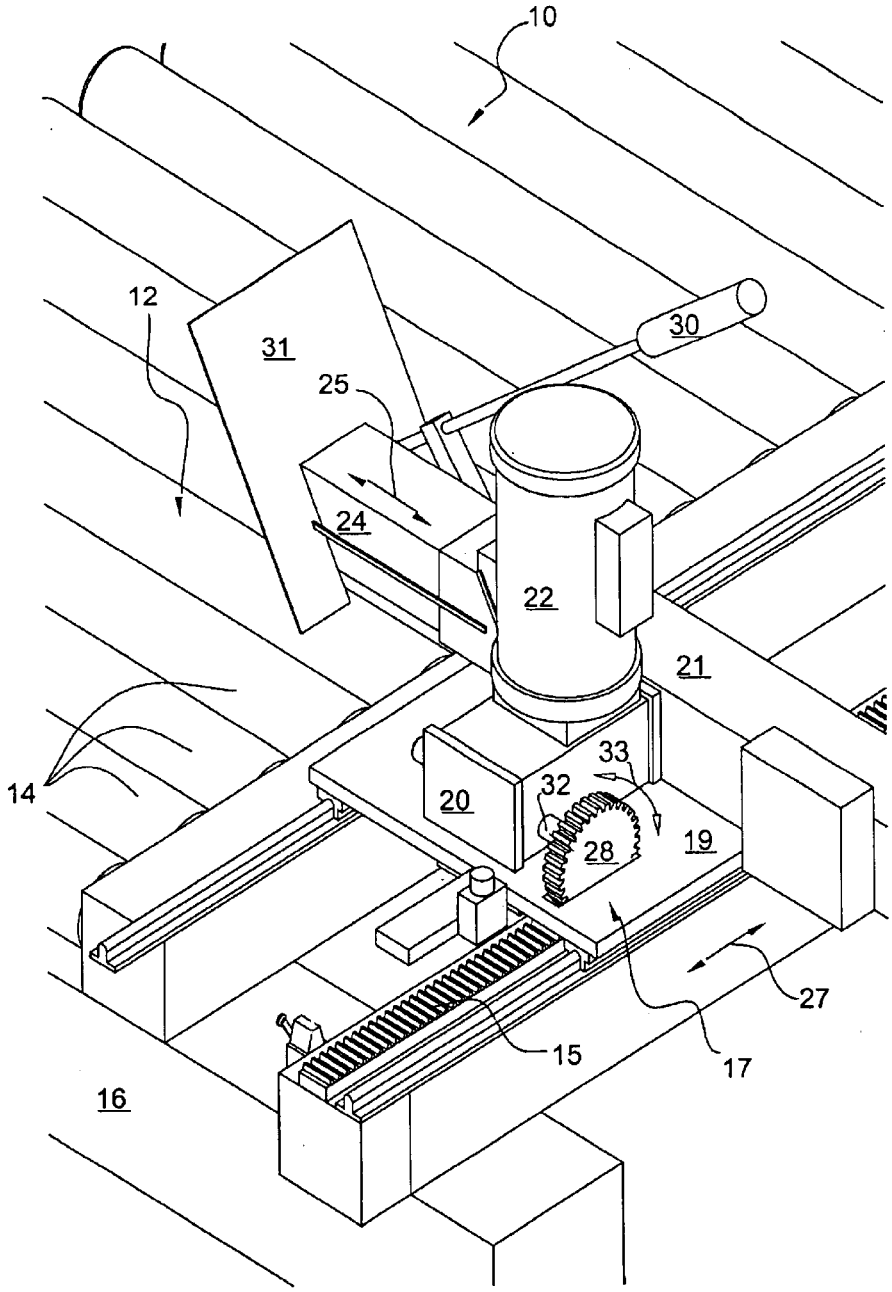
FIG. 1 illustrates a front, enlarged, perspective view of the apparatus of this invention.
Figure 2:
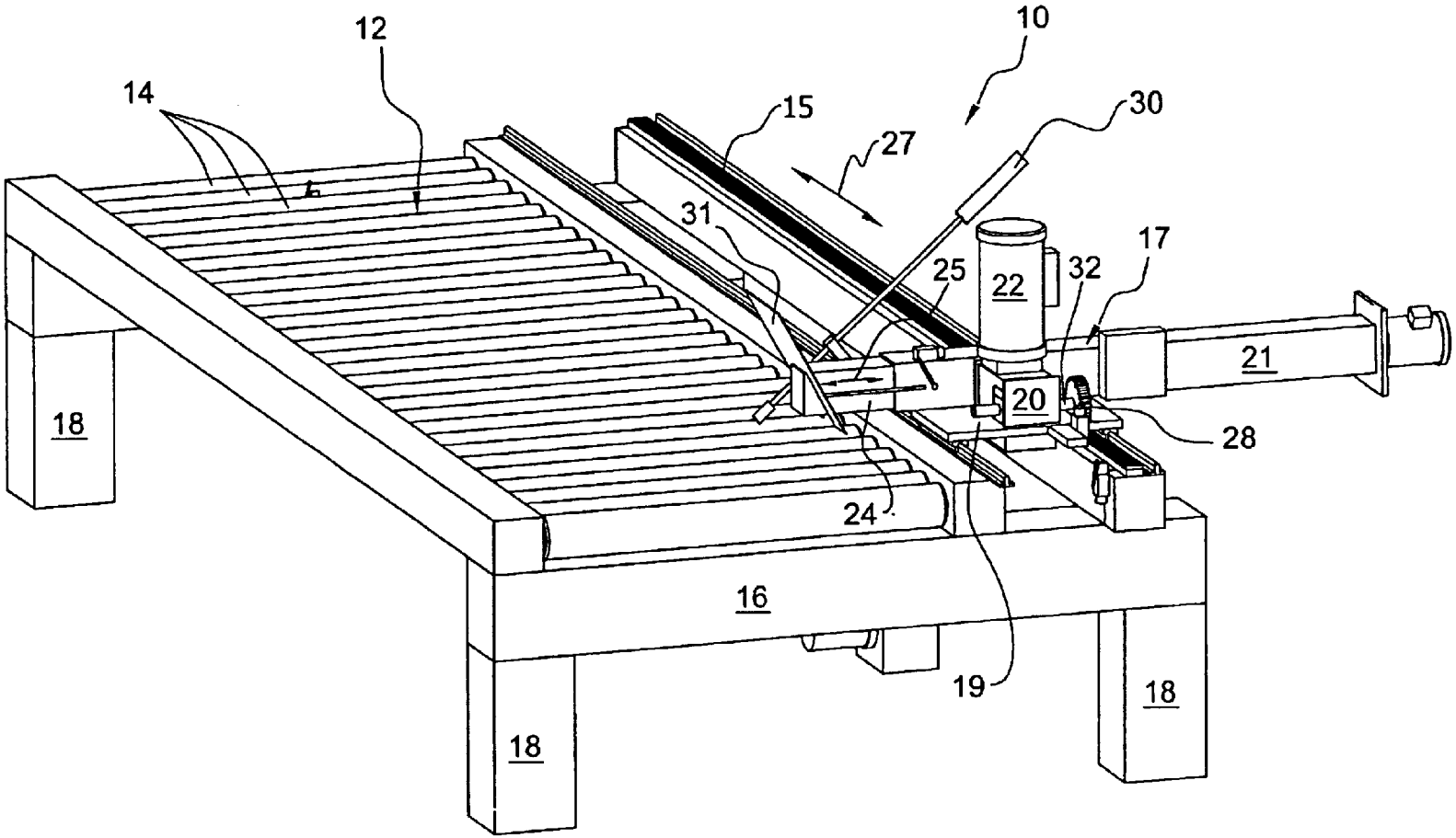
FIG. 2 depicts a side, perspective view of the apparatus of FIG. 1.

Now referring to FIGS. 1 and 2, the stone burning apparatus 10 of this invention is illustrated. A slab or monolith of stone (not shown) is placed upon a bed 12 consisting of a number of rollers 14. The bed 12 also comprises a table 16 supported upon legs 18. The rollers 18 of the bed 12 allow a heavy piece of material to be easily positioned upon the table 16. A gear rack 15 is mounted upon one side of table 16. The gear rack 15 traverses the entire length of the table 16.

A torch assembly 17 is mounted on top of the gear rack 15. The torch assembly 17 comprises a platform 19, upon which a transmission gear box 20 rests. An electrical drive motor 22 is seated above the gear box 20. Also resting upon platform 19 is a telescoping wand 21. The front end 24 of the telescoping wand 21 is perpendicularly movable (arrow 25) with respect to the torch assembly 17 and the platform 19 upon which it rests (arrows 27).

Projecting from the transmission gear box 20 is a pinion gear 28, which drives the platform 19 and torch assembly 17 along the table 16, by reason of its engaging gear rack 15. The pinion gear 28 is caused to rotate (arrows 33), which forces the torch assembly 17 to move relative to the table 16.

The electrical drive motor 22 causes the gears (not shown) in the gear box 20 to drive the pinion gear 28, via shaft 32.

A torch 30 is mounted to the movable, front end 24 of the telescoping wand 21, as shown. Also mounted to the front end of the telescoping wand 21 is a flame shield 31.

Figure 3:
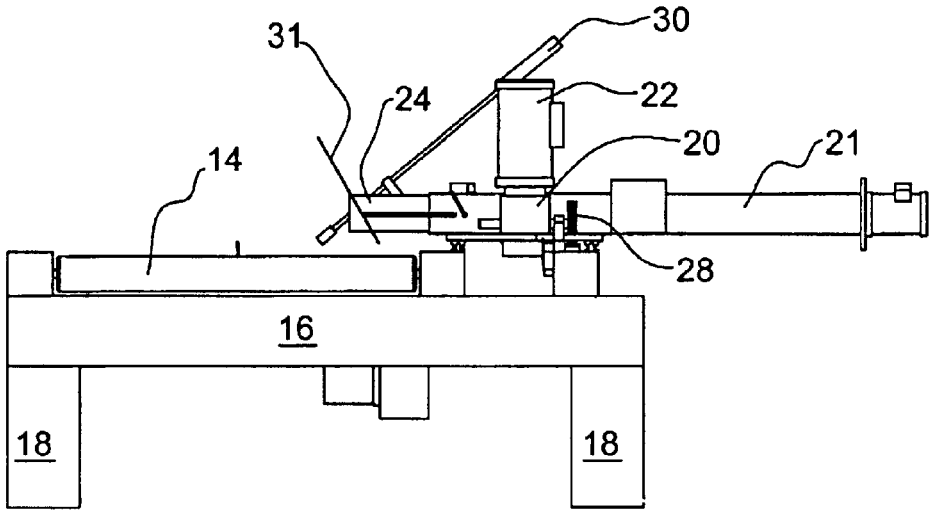
FIG. 3 shows a side view of the apparatus of FIG. 1.
Figure 4:
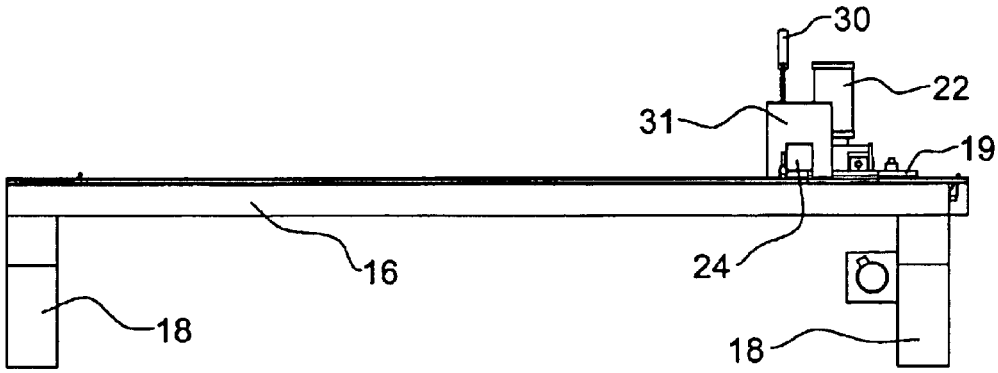
FIG. 4 illustrates a back view of the apparatus of FIG. 1.
Figure 5:
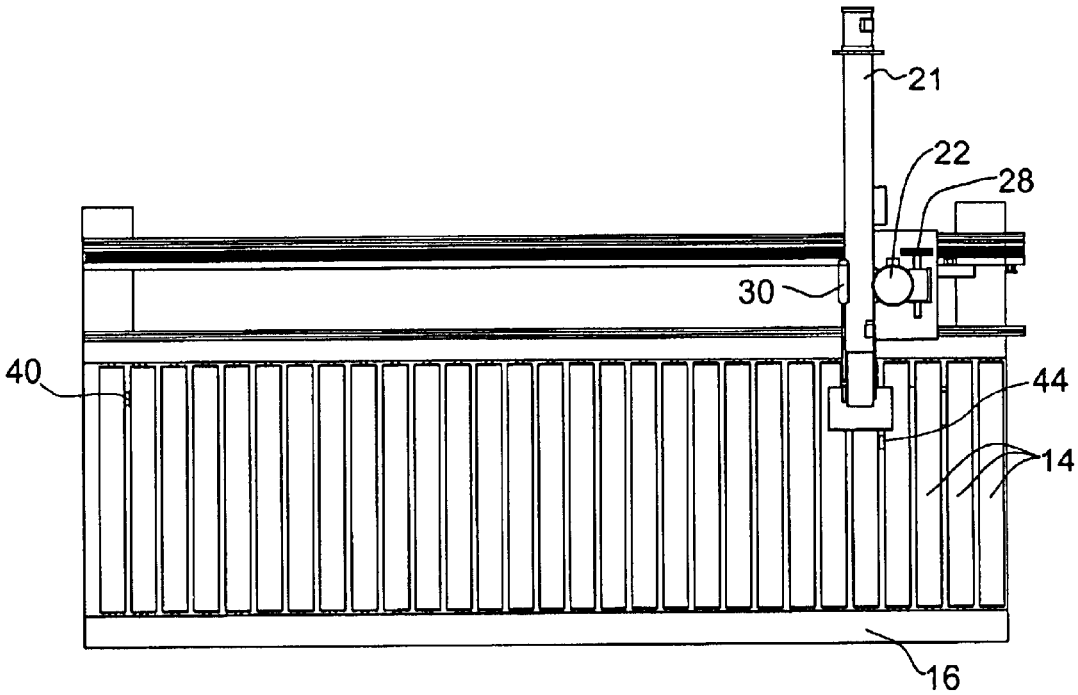
FIG. 5 depicts a top view of the apparatus of FIG. 1.

Referring to FIGS. 3 through 5, side, back, and top views of the apparatus 10 are respectively illustrated.

Figure 6:
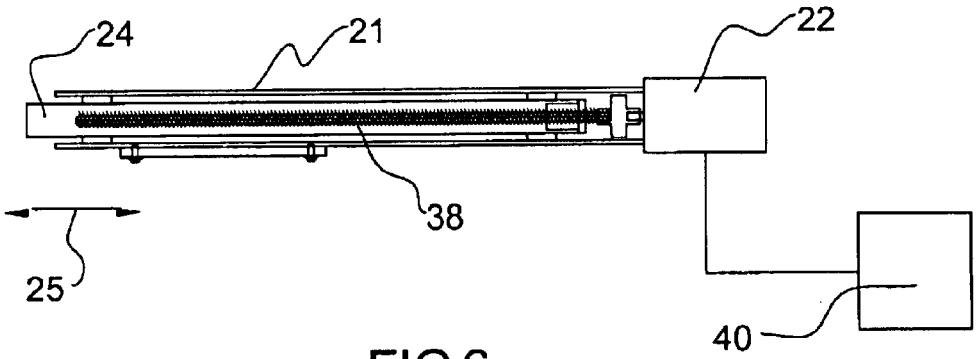
FIG. 6 shows an internal cutaway view, in partial schematic, of the worm assembly and controller of the apparatus illustrated in FIG. 1.

Referring to FIG. 6 an internal cutaway view in partial schematic is shown of the worm assembly and controller of the apparatus 10 of this invention. A controller 40 sends electrical signals to motor 22, thus adjusting its speed and direction. The motor 22 is operatively connected to worm 38, which is caused to turn by motor 22, thus extending, or contracting, the front end 24 of wand 21, as illustrated by arrows 25. Thus, torch 30 is caused to move in proximity to the stone slab (not shown), resting upon table 16. The controller 40 also sends a signal to motor 22 to rotate the pinion gear 28, via gear box 20, and shaft 32. This controls the lateral movement of the assembly 17 with respect to the table 16 and the stone slab, as depicted by arrows 27.

The gas for burning the stone is introduced into the torch 30 under pressure. The gas used to burn the stone is generally a hydrocarbon such as propane, natural gas (methane) or carbon monoxide, in mixture with oxygen. By varying the ratio of the propane and oxygen mixture in a range of between 80:20 and 50:50, different burn temperatures can be achieved. The burn temperature influences the speed by which the assembly 17 is caused to move relative to the table 16.

In operation, a stone is loaded onto an auto conveyor, not shown. The conveyor begins to make the stone travel onto platform 19. As the stone trips a first limit switch 42, the controller 40 begins to count from an analog encoder. When the stone trips a second limit switch 44, the stone stops in its predetermined position and controller 40 saves the measurement given from encoder.

The burn button is then pushed. The torch assembly 17 begins to move along its travel axis and the torch begins to burn the stone. When torch assembly 17 gets to the end of the stone, pursuant to the measurement saved by controller 40, telescoping wand 21 indexes out whatever distance is needed and set by the speed of motor 22.

On the last pass of the torch assembly 17, the operator pushes a park button. The torch assembly 17 finishes the pass and returns to a park position. While the stone is being burned, another stone can be loaded on the conveyor.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A stone burning apparatus that controls a movement of a burning torch to precisely burn a stone, comprising:

a) support means for supporting a stone to be burned; and b) a torch assembly comprising a drive motor, a telescoping wand expanding and contracting in a perpendicular direction toward and away from said stone and supporting a torch, and a worm drive connected to said telescoping wand and said drive motor, said torch assembly being disposed proximate said support means for movement relative to said support means and said stone, in two orthogonal directions relative to the support means and said stone.

2. The stone burning apparatus in accordance with claim 1, wherein said orthogonal directions include perpendicular direction movement toward and away from said stone, and directional movement transversely lateral with respect to said stone.

3. The stone burning apparatus in accordance with claim 1, wherein said torch assembly further comprises a pinion gear operatively connected to, and driven by said drive motor, said pinion gear being in operative engagement with a gear rack disposed upon said support means, said pinion gear driving said torch assembly in a lateral, transverse direction with respect to said support means, and said stone.

4. An automated stone burning apparatus, comprising a stone support for carrying a stone to be burned, a control unit for sending electrical signals to a drive motor for changing speed and direction of said motor, said drive motor being part of a torch assembly proximate of said stone support, said torch assembly further comprising a telescoping wand expanding and contracting in the perpendicular direction and supporting a torch, and a worm drive connected to said telescoping wand and said drive motor, said motor driving said torch assembly for movement relative to said stone support, in two orthogonal directions relative to the stone support.

5. The stone burning apparatus in accordance with claim 4, wherein said orthogonal directions included perpendicular direction movement toward and away from said stone, and directional movement transversely lateral with respect to said stone.

6. The stone burning apparatus in accordance with claim 4, wherein said torch assembly further comprises a pinion gear operatively connected to, and driven by said drive motor, said pinion gear being in operative engagement with a gear rack disposed upon said support means, said pinion gear driving said torch assembly in a lateral, transverse direction with respect to said support means, and said stone.

7. A stone burning apparatus comprising a torch assembly and a drive motor, a telescoping wand expanding and contracting in a perpendicular direction with respect to a stone and stone support means, said torch assembly supporting a torch, and a worm drive connected to said telescoping wand and said drive motor, said torch assembly further comprising a pinion gear operatively connected to, and driven by said drive motor, said pinion gear being in operative engagement with a gear rack disposed upon said support means, said pinion gear driving said torch assembly in a lateral, transverse direction with respect to said support means, and said stone.

* * * * *